US011404770B2

(12) United States Patent
Xie et al.

(10) Patent No.: US 11,404,770 B2
(45) Date of Patent: Aug. 2, 2022

(54) ANTENNA STRUCTURE AND WIRELESS COMMUNICATION DEVICE

(71) Applicants: Futaijing Precision Electronics (Yantai) Co., Ltd., Yantai (CN); FIH (HONG KONG) LIMITED, Kowloon (HK)

(72) Inventors: Jia-Ying Xie, New Taipei (TW); Jia-Hung Hsiao, New Taipei (TW); Chih-Wei Liao, New Taipei (TW)

(73) Assignees: Futaijing Precision Electronics (Yantai) Co., Ltd., Yantai (CN); FIH (HONG KONG) LIMITED, Kowloon (HK)

( * ) Notice: Subject to any disclaimer, the term of this patent is extended or adjusted under 35 U.S.C. 154(b) by 3 days.

(21) Appl. No.: 17/029,363

(22) Filed: Sep. 23, 2020

(65) Prior Publication Data

US 2022/0059931 A1 Feb. 24, 2022

(30) Foreign Application Priority Data

Aug. 19, 2020 (CN) ..... 202010839001.0

(51) Int. Cl.

| | |
|---|---|
| ***H01Q 5/371*** | (2015.01) |
| ***H01Q 9/42*** | (2006.01) |
| ***H01Q 1/36*** | (2006.01) |
| ***H01Q 13/24*** | (2006.01) |

(52) U.S. Cl.

CPC ..... *H01Q 1/36* (2013.01); *H01Q 5/371* (2015.01); *H01Q 9/42* (2013.01); *H01Q 13/24* (2013.01)

(58) Field of Classification Search

CPC ..... H01Q 1/243; H01Q 5/371; H01Q 9/42; H01Q 5/328

See application file for complete search history.

(56) References Cited

U.S. PATENT DOCUMENTS

| | | | | |
|---|---|---|---|---|
| 10,158,384 | B1 * | 12/2018 | Yarga | H01Q 13/103 |
| 2019/0181553 | A1 * | 6/2019 | Lee | H01Q 5/35 |
| 2019/0348750 | A1 * | 11/2019 | Lin | H01Q 1/521 |
| 2021/0135362 | A1 * | 5/2021 | Hsu | H01Q 5/371 |

FOREIGN PATENT DOCUMENTS

| | | | |
|---|---|---|---|
| TW | 202005166 | A | 1/2020 |

* cited by examiner

*Primary Examiner* — Ricardo I Magallanes

(74) *Attorney, Agent, or Firm* — ScienBiziP, P.C.

(57) ABSTRACT

An antenna structure includes a frame portion and a feeding portion. The frame portion is provided with a first gap and a second gap. The first gap and the second gap penetrate and divide the frame portion into a first radiating portion, a second radiating portion, and a third radiating portion. The feeding portion is arranged on the first radiating portion adjacent to the second gap. One end of the feeding portion is electrically coupled to the first radiating portion, and the other end of the feeding portion is electrically coupled to a feeding point to feed current to the first radiating portion. The second radiating portion and/or the third radiating portion is provided with a side slot. A radiation frequency band of the second radiating portion and/or the third radiating portion where the side slot is located is adjusted by adjusting the length of the side slot.

12 Claims, 16 Drawing Sheets

ANTENNA STRUCTURE AND WIRELESS COMMUNICATION DEVICE

FIELD

The subject matter herein generally relates to antenna structures, and more particularly to an antenna structure of a wireless communication device.

BACKGROUND

With the continuous development and evolution of wireless communication technology, mobile terminal products, such as mobile phones, have reduced space for accommodating the antenna. Moreover, with the development of wireless communication technology, the demand for antenna bandwidth is also increasing. Therefore, how to design an antenna with a wider bandwidth in a limited space is an important issue facing antenna design.

BRIEF DESCRIPTION OF THE DRAWINGS

Implementations of the present disclosure will now be described, by way of embodiments, with reference to the attached figures.

DETAILED DESCRIPTION

Figure 1:
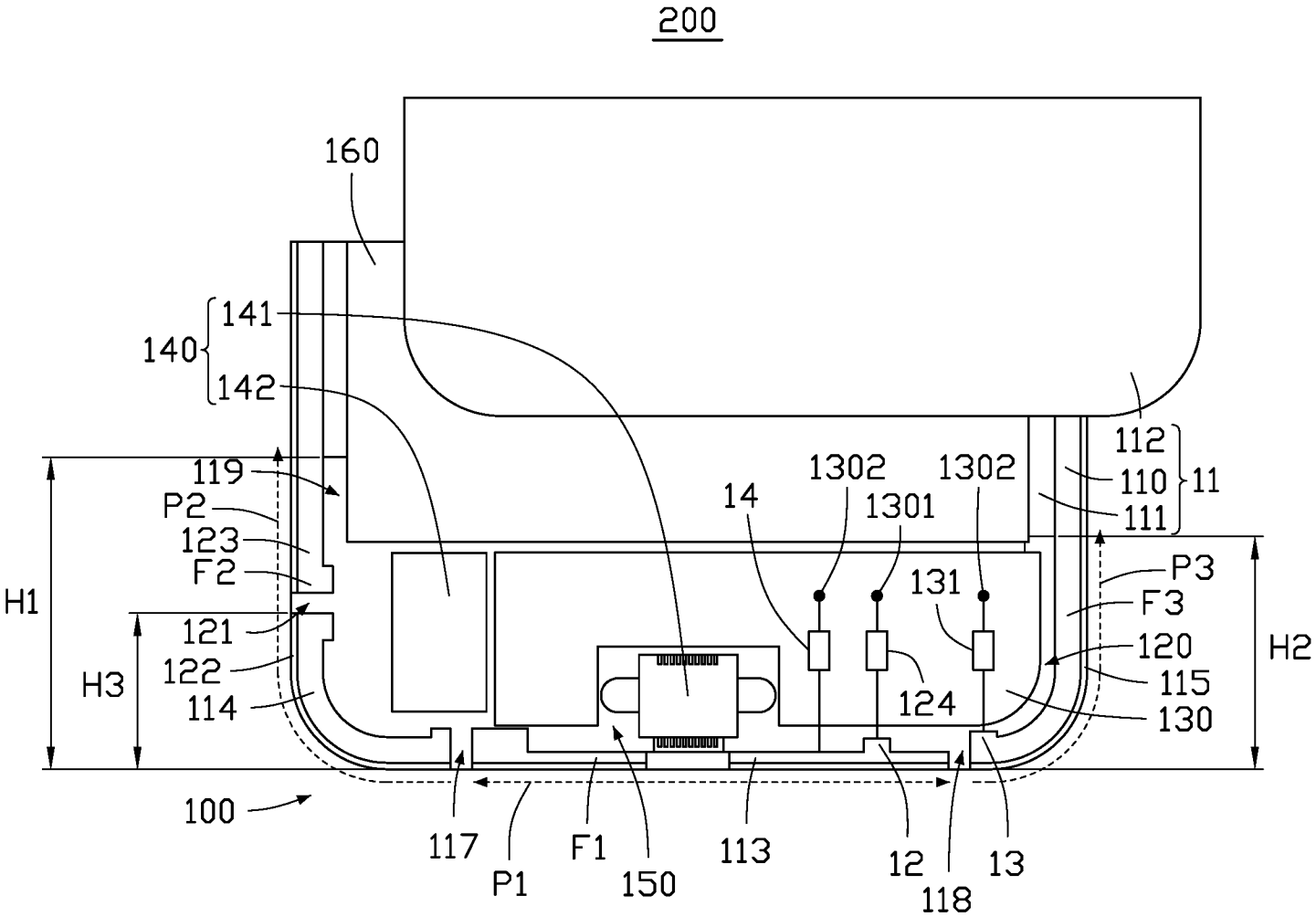
FIG. 1 is a schematic diagram of an antenna structure according to an embodiment of the present application.

It will be appreciated that for simplicity and clarity of illustration, where appropriate, reference numerals have been repeated among the different figures to indicate corresponding or analogous elements. Additionally, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or another word that "substantially" modifies, such that the component need not be exact. For example, "substantially cylindrical" means that the object resembles a cylinder, but can have one or more deviations from a true cylinder. The term "comprising" means "including, but not necessarily limited to"; it specifically indicates open-ended inclusion or membership in a so-described combination, group, series, and the like.

FIG. 1 shows an embodiment of an antenna structure 100 that can be applied to a wireless communication device 200, such as a mobile phone or personal digital assistant, for transmitting and receiving radio waves for transmitting and exchanging wireless signals.

The antenna structure 100 includes a housing 11, a feeding portion 12, a ground portion 13, and a switching circuit 14.

The housing 11 includes a frame portion 110, a middle frame portion 111, and a back plate 112. A circuit board 130, an electronic component 140, and a battery 160 are arranged in a space enclosed by the frame portion 110, the middle frame portion 111, and the back plate 112.

The frame portion 110 is a substantially annular structure made of metal or other conductive material. The frame portion 110 is arranged on a periphery of the middle frame portion 111.

In one embodiment, the middle frame portion 111 is substantially rectangular and made of metal or other conductive material. The middle frame portion 111 is substantially parallel to the back plate 112.

Figure 2:
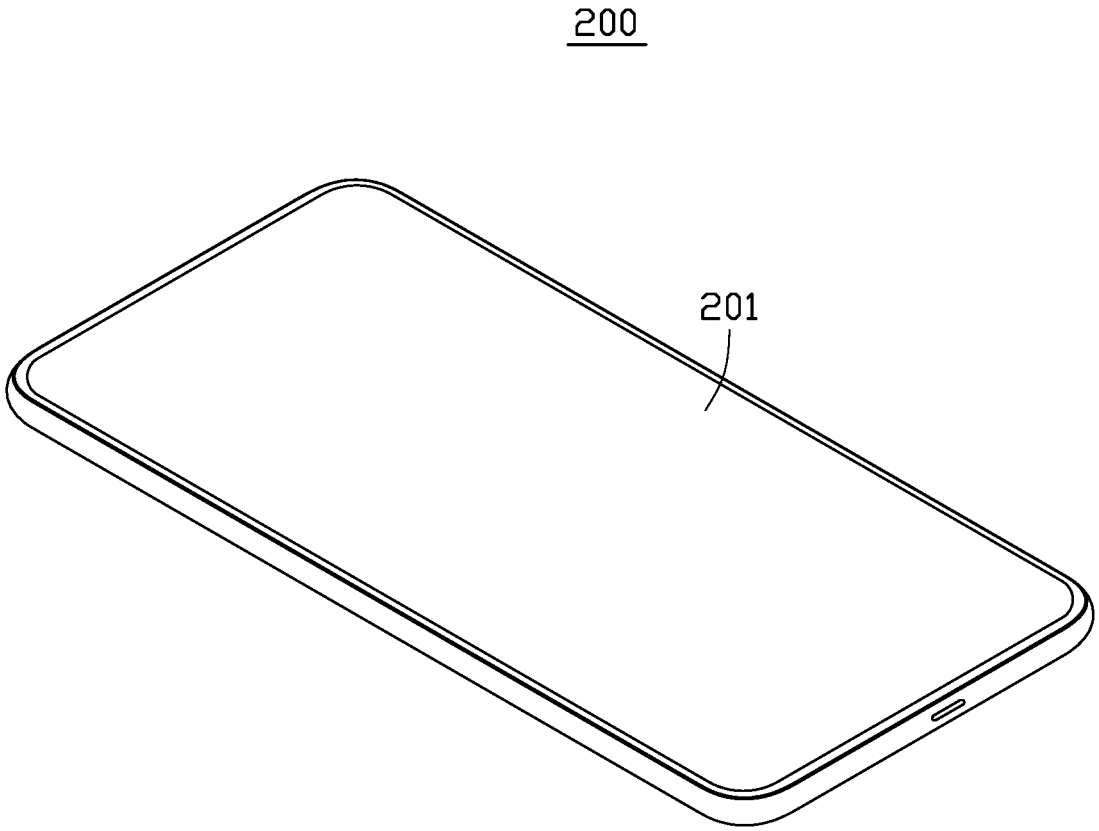
FIG. 2 is a schematic diagram of the assembly of the wireless communication device shown in FIG. 1.

Referring to FIG. 2, an opening (not labeled) is defined in a side of the frame portion 110 away from the back plate 112 for accommodating a display unit 201 of the wireless communication device 200. The display unit 201 includes a display screen exposed at the opening. In one embodiment, the display screen is a full screen.

In one embodiment, the back plate 112 is made of plastic. The back plate 112 is arranged on an edge of the frame portion 110. In one embodiment, the back plate 112 is arranged on a side of the middle frame portion 111 facing away from the display unit 201 and is substantially parallel to the display screen of the display unit 201 and the middle frame portion 111.

It can be understood that the frame portion 110 and the middle frame portion 111 may constitute an integrally formed metal frame. The middle frame portion 111 is a metal sheet located between the display unit 201 and the back plate 112. The middle frame portion 111 is used to support the display unit 201, provide electromagnetic shielding, and improve a mechanical strength of the wireless communication device 200.

In one embodiment, the frame portion 110, the back plate 112, and a periphery of the display unit 201 are further provided with an insulating material, and the frame portion 110, the back plate 112, and the display unit 201 are packaged as a whole.

In one embodiment, the frame portion 110 includes an end portion 113, a first side portion 114, and a second side portion 115. The end portion 113 is a bottom end of the wireless communication device 200, that is, the antenna structure 100 constitutes a lower antenna of the wireless communication device 200. The first side portion 114 and the second side portion 115 are arranged opposite each other, and first side portion 114 and the second side portion 115 are arranged substantially perpendicularly at both ends of the end portion 113, respectively.

In one embodiment, a side of the middle frame portion 111 adjacent to the end portion 113 is spaced apart from the frame portion 110 to form a clearance area 150.

The frame portion 110 is also provided with at least two gaps, such as a first gap 117 and a second gap 118. The first gap 117 is defined in the end portion 113 adjacent to the first side portion 114. The second gap 118 is defined in the end portion 113 adjacent to the second side portion 115. The first gap 117 and the second gap 118 are spaced apart. The first gap 117 and the second gap 118 penetrate and divide the frame portion 110. The first gap 117 and the second gap 118 communicate with the clearance area 150.

The first gap 117 and the second gap 118 jointly divide the frame portion 110 into a first radiating portion F1, a second radiating portion F2, and a third radiating portion F3 arranged at intervals. The frame portion 110 between the first gap 117 and the second gap 118 forms the first radiating portion F1. The frame portion 110 on a side of the first gap 117 away from the first radiating portion F1 and the second gap 118 forms the second radiating portion F2. The frame portion 110 on a side of the second gap 118 away from the first radiating portion F1 and the first gap 117 forms the third radiating portion F3.

In one embodiment, the circuit board 130 is partially arranged on a side of the middle frame portion 111 away from the display unit 201 so that the circuit board 130 partially covers the clearance area 150. The circuit board 130 is also arranged adjacent to the second side portion 115 and the end portion 113. The electronic component 140 is arranged adjacent to the first side portion 114 and the end portion 113.

In one embodiment, the electronic component 140 includes at least a first electronic component 141 and a second electronic component 142.

In one embodiment, the first electronic component 141 is a USB-TypeC component. The first electronic component 141 is arranged adjacent to the edge of the first radiating portion F1 and is accommodated in a gap of the circuit board 130. In one embodiment, the middle frame portion 111 is provided with a Type-C socket (not shown) corresponding to the first electronic component 141. The Type-C socket is formed on the end portion 113. The second electronic component 142 is a speaker component. The second electronic component 142 is arranged in the clearance area 150 corresponding to the first gap 117 and is arranged spaced apart from the circuit board 130.

In one embodiment, a width of the first gap 117 is equal to a width of the second gap 118, and the widths of the first gap 117 and the second gap 118 are 2 mm.

In one embodiment, both the first gap 117 and the second gap 118 are filled with an insulating material (such as plastic, rubber, glass, wood, ceramic, or the like).

In one embodiment, the feeding portion 12 is arranged inside the housing 11 and located in the clearance area 150 between the circuit board 130 and the frame portion 110. Further, the feeding portion 12 is arranged on the first radiating portion F1, specifically at a position of the first radiating portion F1 adjacent to the second gap 118. One end of the feeding portion 12 is electrically coupled to the first radiating portion F1, and the other end of the feeding portion 12 is electrically coupled to a signal feeding point 1301 on the circuit board 130 through a matching circuit 124 (shown in FIG. 3) for feeding electric current to the first radiating portion F1.

In one embodiment, the ground portion 13 is arranged inside the housing 11 and located in the clearance area 150 between the circuit board 130 and the frame portion 110. Further, the ground portion 13 is arranged on the third radiating portion F3, specifically arranged at a position of the third radiating portion F3 adjacent to the second gap 118. One end of the ground portion 13 is electrically coupled to the third radiating portion F3, and the other end of the ground portion 13 is electrically coupled to a ground point 1302 on the circuit board 130 through a matching circuit 131 (shown in FIG. 4) for grounding the radiating portion F3.

It can be understood that the feeding portion 12 and the ground portion 13 can be made of iron, copper foil, or other conducting material in a laser direct structuring (LDS) process.

In one embodiment, the switching circuit 14 is arranged inside the housing 11 and located in the clearance area 150 between the circuit board 130 and the frame portion 110. Further, the switching circuit 14 is spaced apart from the feeding portion 12. One end of the switching circuit 14 is electrically coupled to the first radiating portion F1, and the other end of the switching circuit 14 is electrically coupled to ground through the ground point 1302 of the circuit board 130.

Referring again to FIG. 1, after the feeding portion 12 feeds current, the current flows through the first radiating portion F1, flows to the first gap 117, and is grounded through the switching circuit 14 (see path P1), thereby exciting a first mode to generate a radiation signal in a first radiation frequency band. At the same time, the current flowing to the first gap 117 is coupled to the second radiating portion F2 through the first gap 117, and coupled to the middle frame portion 111 through the second radiating portion F2, and then grounded (see path P2), thereby exciting a second mode to generate a radiation signal in a second radiation frequency band.

After the feeding portion 12 feeds current, the current flows through the first radiating portion F1 and also flows to the second gap 118. The current flowing to the second gap 118 is coupled to the third radiating portion F3 through the second gap 118, and is grounded through a ground portion 13 provided on the third radiating portion F3 (see path P3), thereby exciting a third mode to generate a radiation signal in a third radiation frequency band.

In one embodiment, at least one side slot is defined in an inner side of the second radiating portion F2 and/or the third radiating portion F3. By adjusting a length of the side slot, a working frequency band where the side slot is located can be adjusted.

In one embodiment, the side slot includes a first side slot 119 and a second side slot 120. One side of the middle frame portion 111 adjacent to the second radiating portion F2 is hollowed out, so that the second radiating portion F2 is spaced apart from the middle frame portion 111 to form the first side slot 119. The first side slot 119 extends from the second radiating portion F2 to the first radiating portion F1. One side of the middle frame portion 111 adjacent to the third radiating portion F3 is hollowed out, so that the inner side of the third radiating portion F3 and the middle frame portion 111 are spaced apart to form the second side slot 120. The second side slot 120 extends from the third radiating portion F3 to the first radiating portion F1. It can be understood that the clearance area 150, the first side slot 119, and the second side slot 120 communicate with each other.

A first end of the first side slot 119 is located at a position where the second radiating portion F2 is opposite to the battery 160, and a second end of the first side slot 119 is in communication with the clearance area 150. By adjusting the length of the first side slot 119, the radiation frequency band of the second radiating portion F2 can be adjusted. In one embodiment, a distance H1 between the first end of the first side slot 119 and the end portion 113 is 28.3 mm. When the length of the first side slot 119 increases, that is, when the distance H1 between the first end of the first side slot 119 and the end portion 113 increases, the second radiation frequency band generated by the second radiating portion F2 is shifted toward an intermediate frequency. When the length of the first side slot 119 decreases, that is, when the distance H1 between the first end of the first side slot 119 and the end portion 113 decreases, the second radiation frequency band generated by the second radiating portion F2 is shifted toward a higher frequency. For example, when the distance H1 between the first end of the first side slot 119 and the end portion 113 is 28.3 mm, the second radiation frequency band covers the LTE-A Band41 frequency band (2.496 GHz-2.69 GHz). When the distance H1 between the first end of the first side slot 119 and the end portion 113 is 29.3 mm, the second radiation frequency band covers the 2.4 GHz-2.5 GHz frequency band, that is, the second radiation frequency band is shifted toward a lower frequency. When the distance H1 between the first end of the first side slot 119 and the end portion 113 is 30.3 mm, the second radiation frequency band covers the LTE-A Band40 frequency band (2.3 GHz-2.4 GHz), that is, the second radiation frequency band continues to shift toward a lower frequency. When the distance H1 between the first end of the first side slot 119 and the end portion 113 is 27.3 mm, the second radiation frequency band covers the LTE-A Band7 frequency band (2.5 GHz-2.69 GHz), that is, the second radiating frequency band is shifted toward a higher frequency. When the distance H1 between the first end of the first side slot 119 and the end portion 113 is 26.3 mm, the second radiation frequency band covers 2.6 GHz-2.8 GHz, that is, the second radiation frequency band continues to shift toward a higher frequency.

A first end of the second side slot 120 is located at a position where the third radiating portion F3 is opposite to the battery 160, and a second end of the second side slot 120 is in communication with the clearance area 150. By adjusting the length of the second side slot 120, the radiation frequency band of the third radiating portion F3 can be adjusted. In one embodiment, a distance H2 between the first end of the second side slot 120 and the end portion 113 is 21.2 mm. When the length of the second side slot 120 decreases, that is, when the distance H2 between the first end of the second side slot 120 and the end portion 113 decreases, the third radiation frequency band generated by the third radiating portion F3 shifts to a higher frequency. For example, when the distance H2 between the first end of the second side slot 120 and the end portion 113 is 21.2 mm or 20.2 mm, the third radiation frequency band covers the LTE-A Band10 frequency band (1.71 GHz-2.17 GHz). When the distance H2 between the first end of the second side slot 120 and the end portion 113 is 19.2 mm, 18.2 mm, or 17.2 mm, the third radiation frequency band covers the LTE-A Band41 frequency band (2.49 GHz-2.69 GHz), that is, the third radiation frequency band shifts to a higher frequency.

In one embodiment, the first mode includes the Global System for Mobile Communications (GSM) mode and the Long Term Evolution Advanced (LTE-A) low frequency mode. The second mode includes the LTE-A high frequency mode, the Bluetooth mode, and the WIFI 2.4 G mode. The third mode includes the LTE-A intermediate frequency mode and the Universal Mobile Telecommunications System (UMTS) mode. The frequency of the first radiation frequency band is 0.69 GHz to 0.96 GHz, the frequency of the second radiation frequency band is 2.3 GHz to 2.69 GHz, and the frequency of the third radiation frequency band is 1.71 GHz to 2.17 GHz.

In one embodiment, by adjusting the length of the first side slot 119, the frequency of the second radiation frequency band can be adjusted. For example, when the length of the first side slot 119 increases, the second radiation frequency band of the antenna structure 100 shifts toward an intermediate frequency. When the length of the first side slot 119 decreases, the second radiation frequency band of the antenna structure 100 shifts toward a higher frequency. In this way, the length of the first side slot 119 can be adjusted to make the second radiating portion F2 work in the second mode or the third mode.

In one embodiment, by adjusting the length of the second side slot 120, the frequency of the third radiation frequency band can be adjusted. When the length of the second side slot 120 decreases, the third radiation frequency band of the antenna structure 100 shifts toward a higher frequency. In this way, the length of the second side slot 120 can be adjusted to make the third radiating portion F3 work in the second mode or the third mode.

In one embodiment, a third gap 121 is further provided on the second radiating portion F2. The third gap 121 is defined in the first side portion 114 at a position corresponding to the second electronic component 142. The third gap 121 and the first gap 117 are spaced apart. The third gap 121 penetrates and divides the frame portion 110 and communicates with the clearance area 150. The third gap 121 divides the second radiating portion F2 into a first radiating section 122 and a second radiating section 123. In one embodiment, a width of the third gap 121 is 2 mm.

It can be understood that after the feeding portion 12 feeds current, the current flows to the first gap 117 and is coupled to the first radiating section 122 through the first gap 117. The current flows through the first radiating section 122 and is coupled to the second radiating section 123 through the third gap 121, thereby exciting the second mode to generate the radiation signal in the second radiation frequency band.

It can be understood that by adjusting the position of the third gap 121 on the second radiating portion F2, the frequency of the second radiating frequency band can be adjusted. For example, when the position of the third gap 121 on the second radiating portion F2 moves away from the first radiating portion F1, the second radiation frequency band shifts to a higher frequency. When the position of the third gap 121 on the second radiating portion F2 moves toward the first radiating portion F1, the second radiation frequency band shifts to a lower frequency. In one embodiment, a distance H3 between an end of the third gap 121 adjacent to the first gap 117 and the end portion 113 is 13 mm. Thus, the second radiation frequency band generated by the second radiating portion F2 covers the LTE-A Band41 frequency band (2.496 GHz-2.69 GHz). When the distance H3 between the end of the third gap 121 adjacent to the first gap 117 and the end portion 113 is 14 mm, the second radiation frequency band covers the LTE-A Band38 frequency band (2.57 GHz-2.62 GHz), that is, the second radiation frequency band shifts to a higher frequency. When the distance H3 between the end of the third gap 121 adjacent to the first gap 117 and the end portion 113 is 15 mm, the second radiation frequency band covers the LTE-A Band7 frequency band (2.5 GHz to 2.69 GHz), that is, the second radiation frequency band is shifted toward a higher frequency. When the distance H3 between the end of the third gap 121 adjacent to the first gap 117 and the end portion 113 is 12 mm, the second radiation frequency band covers 2.4 GHz-2.5 GHz, that is, the second radiation frequency band shifts toward a lower frequency. When the distance H3 between the end of the third gap 121 adjacent to the first gap 117 and the end portion 113 is 11 mm, the second radiation frequency band covers the LTE-A Band40 frequency band (2.3 GHz-2.4 GHz), that is, the second radiation frequency band continues to shift toward a lower frequency.

Figure 3:
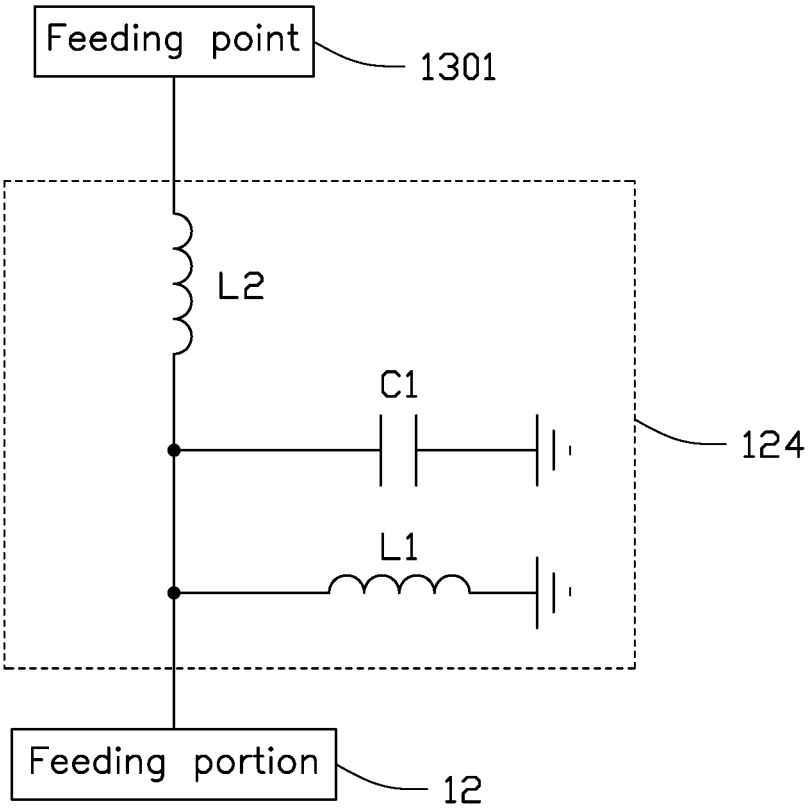
FIG. 3 is a circuit diagram of a first matching circuit in the antenna structure of FIG. 1.

Referring to FIG. 3, in one embodiment, the matching circuit 124 includes a first inductor L1, a second inductor L2, and a capacitor C1. One end of the first inductor L1 is grounded, and the other end of the first inductor L1 is electrically coupled to the feeding portion 12. One end of the second inductor L2 is electrically coupled to the feeding point 1301 of the circuit board 130, and the other end of the second inductor L2 is electrically coupled to the feeding portion 12. One end of the capacitor C1 is grounded, and the other end of the capacitor C1 is electrically coupled to the feeding portion 12, that is, after the capacitor C1 is coupled in parallel with the first inductor L1, the capacitor C1 is coupled in series with the second inductor L2 between the circuit board 130 and the feeding portions 12 of the first radiating portion F1.

In one embodiment, an inductance value of the first inductor L1 is 10 nH, an inductance value of the second inductor L2 is 1 nH, and a capacitance value of the first capacitor C1 is 1.5 pF.

Figure 4:
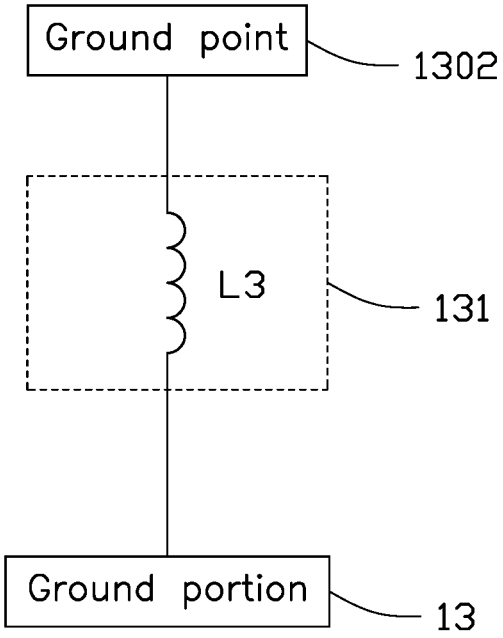
FIG. 4 is a circuit diagram of a second matching circuit in the antenna structure shown in FIG. 1.

Referring to FIG. 4, in one embodiment, the matching circuit 131 includes a third inductor L3. One end of the third inductor L3 is electrically coupled to the ground point 1302 of the circuit board 130, that is, grounded. The other end of the third inductor L3 is electrically coupled to the ground portion 13. It can be understood that by adjusting the inductance value of the third inductor L3 to adjust the third radiation frequency band, the frequency of the intermediate frequency band of the antenna structure 100 is effectively adjusted. Wherein, when the inductance value of the third inductor L3 decreases, the third radiation frequency band shifts from the intermediate frequency toward the higher frequency. For example, when the inductance value of the third inductor L3 is 10 nH, the third radiation frequency band generated by the third radiating portion F3 covers the LTE-A Band3 frequency band (1.71 GHz-1.88 GHz). When the inductance value of the third inductor L3 is 6.8 nH, the third radiation frequency band generated by the third radiating portion F3 covers the LTE-A Band2 frequency band (1.85 GHz-1.99 GHz). When the inductance value of the third inductor L3 is 3.3 nH, the third radiation frequency band generated by the third radiating portion F3 covers the LTE-A Band1 frequency band (1.92 GHz-2.17 GHz).

Figure 5:
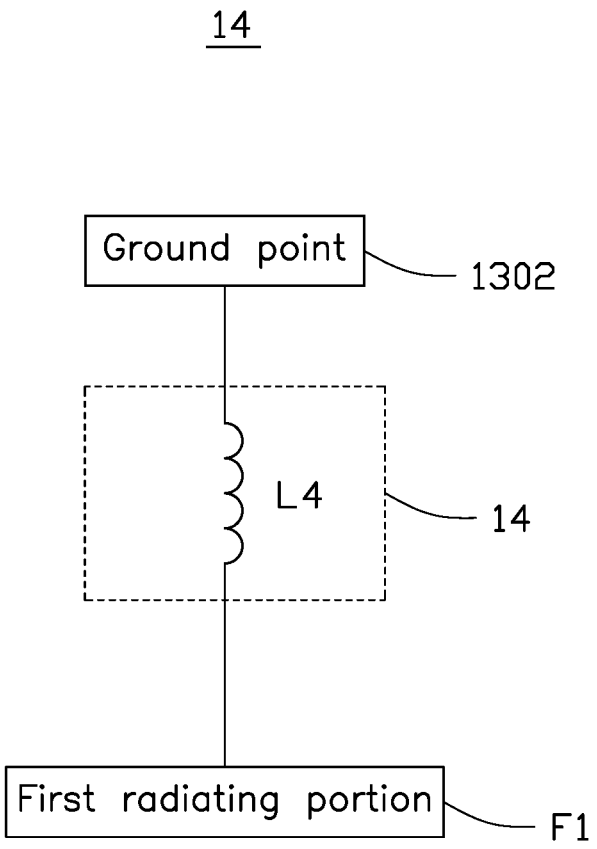
FIG. 5 is a circuit diagram of a switching circuit in the antenna structure shown in FIG. 1.

Referring to FIG. 5, in one embodiment, the switching circuit 14 includes a fourth inductor L4. One end of the fourth inductor L4 is electrically coupled to the ground point 1302, that is, grounded. The other end of the fourth inductor L4 is electrically coupled to the first radiating portion F1. The switching circuit 14 is used to adjust the first radiation frequency band. It can be understood that in one embodiment, the first radiation frequency band is adjusted by adjusting the inductance value of the fourth inductor L4, thereby effectively adjusting the frequency of the low frequency band of the antenna structure 100. Wherein, when the inductance value of the fourth inductor L4 decreases, the first radiation frequency band shifts from a low frequency to an intermediate frequency. For example, when the inductance value of the fourth inductor L4 is 15 nH, the first radiation frequency band covers the LTE-A Band17 frequency band (704-746 MHz). When the inductance value of the fourth inductor L4 is 6.8 nH, the first radiation frequency band covers the LTE-A Band13 frequency band (746-787 MHz). When the inductance value of the fourth inductor is 3 nH, the first radiation frequency band covers the LTE-A Band20 frequency band (791-862 MHz). When the inductance value of the fourth inductor is 1.5 nH, the first radiation frequency band covers the LTE-A Band8 frequency band (880-960 MHz). In this way, by switching different inductance values, the low frequency of the first mode in the antenna structure 100 covers the LTE-A Band17 frequency band (704-746 MHz), LTE-A Band13 frequency band (746-787 MHz), LTE-A Band20 frequency band (791-862 MHz), and LTE-A Band8 frequency band (880-960 MHz).

Figure 6:
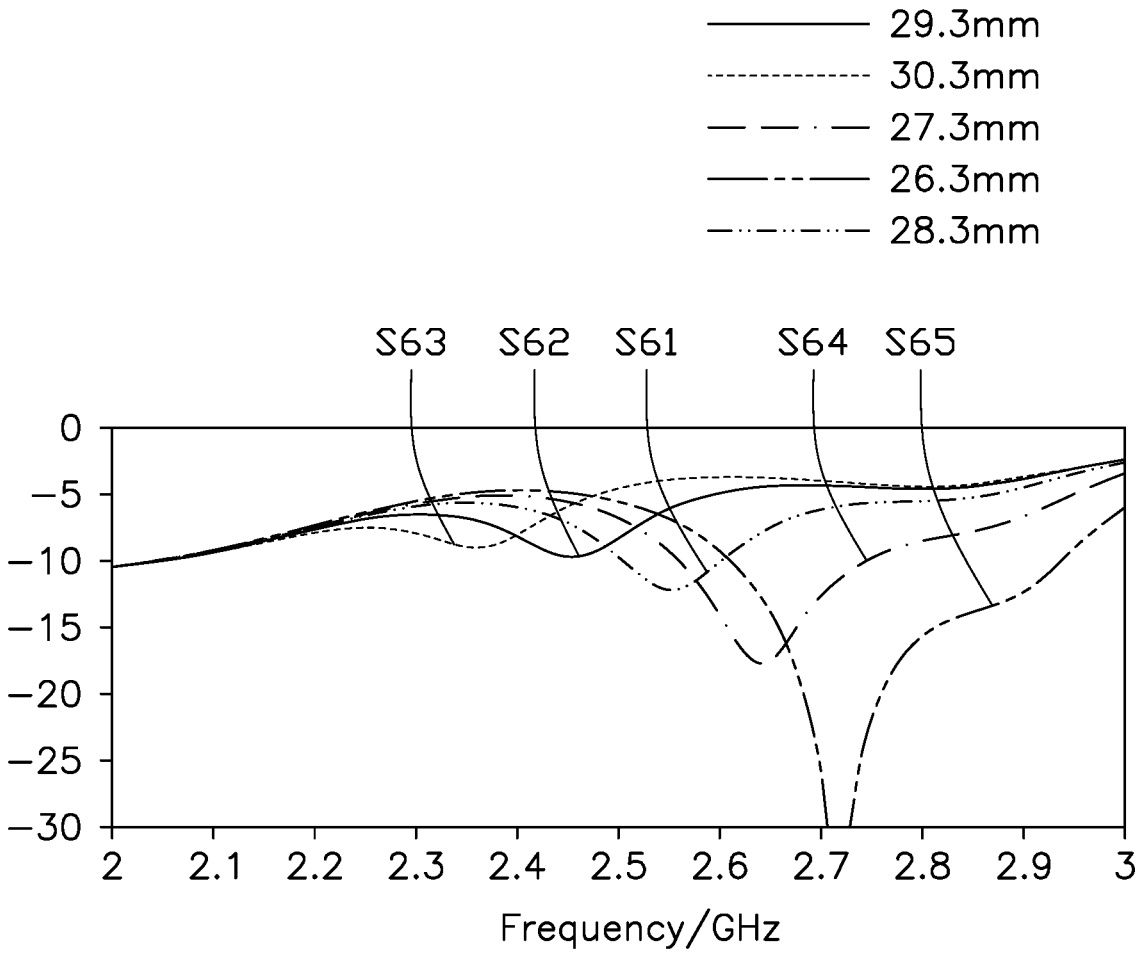
FIG. 6 is a graph of scattering parameters (S parameters) when the antenna structure works in the LTE-A high frequency mode and the WIFI 2.4 G mode when the length of the first side slot shown in FIG. 1 is adjusted.

FIG. 6 is a graph of scattering parameters (S parameters) when the antenna structure 100 works in the LTE-A high frequency mode and the WIFI 2.4 G mode when the length of the first side slot 119 shown in FIG. 1 is adjusted. Wherein, the curves S61, S62, S63, S64, and S65 are S11 values when the distance H1 between the first end of the first side slot 119 and the end portion 113 is 28.3 mm, 29.3 mm, 30.3 mm, 27.3 mm, and 26.3 mm, respectively, and the antenna structure 100 works in the LTE-A Band41 frequency band (2.496 GHz-2.69 GHz), WIFI 2.4 G frequency band, LTE-A Band40 frequency band (2.3 GHz-2.4 GHz), LTE-A Band7 frequency band (2.5 GHz-2.69 GHz), and 2.6 GHz-2.8 GHz.

Figure 7:
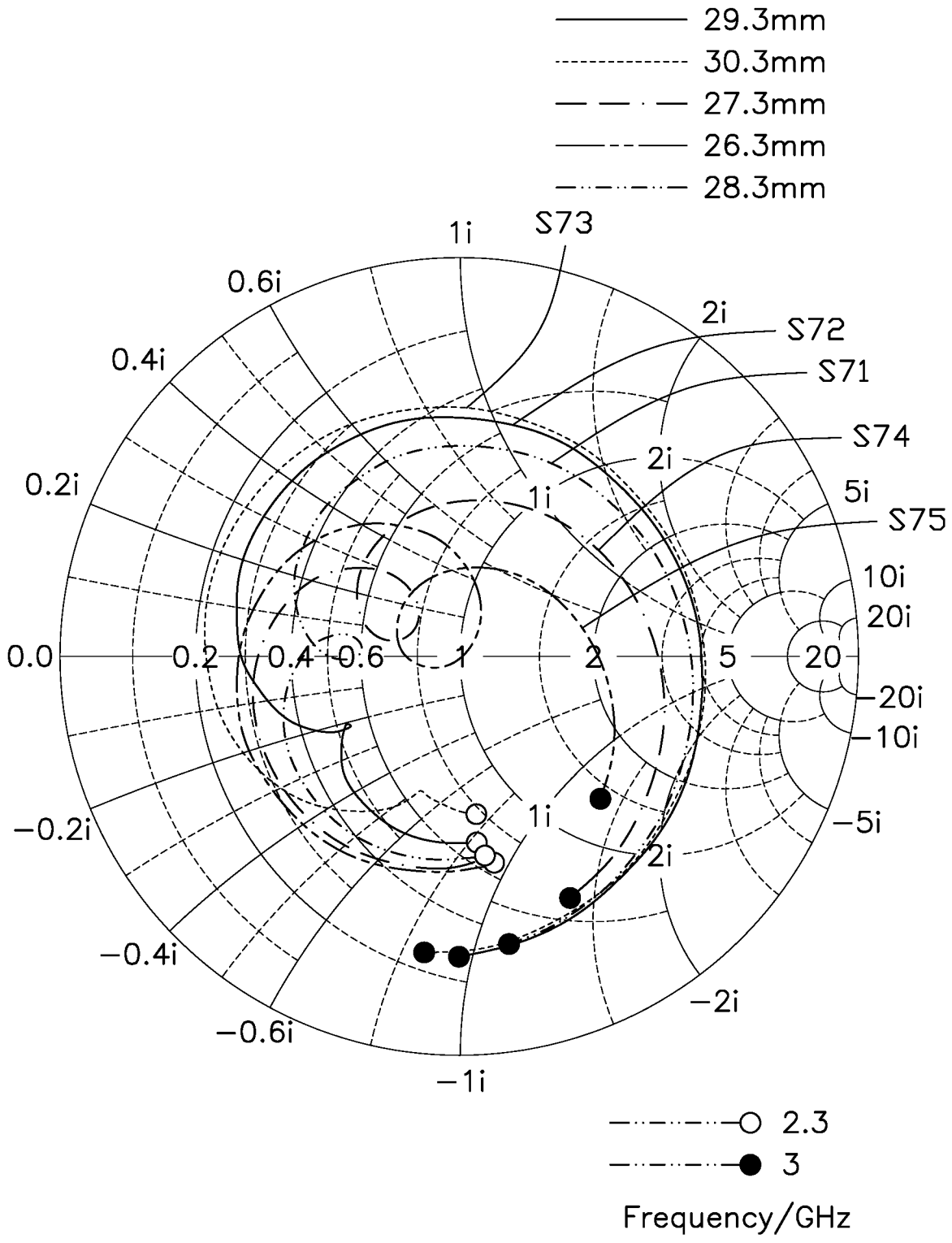
FIG. 7 is a Smith chart of the antenna structure when the length of the first side slot in the antenna structure shown in FIG. 1 is adjusted when the antenna structure works in the LTE-A high frequency mode and the WIFI 2.4 G mode.

FIG. 7 is a Smith chart of the antenna structure 100 when the length of the first side slot 119 shown in FIG. 1 is adjusted and the antenna structure 100 works in the LTE-A high frequency mode and the WIFI 2.4 G mode, that is, the 2.3 GHz-3 GHz frequency band. Wherein, the curves S71, S72, S73, S74, and S75 are impedence curves when the distance H1 between the first end of the first side slot 119 and the end portion 113 is 28.3 mm, 29.3 mm, 30.3 mm, 27.3 mm, and 26.3 mm, respectively, and the antenna structure 100 operates in the 2.3 GHz-3 GHz frequency band.

It can be seen from FIG. 6 and FIG. 7 that by adjusting the length of the first side slot 119, the second radiating portion F2 works in the second radiation frequency band, such as 2.3 GHz to 2.69 GHz. The S11 value and the corresponding impedance curve show that the corresponding return loss and reflection coefficient are relatively low, which can meet the requirements of antenna working design. Wherein, when the length of the first side slot 119 increases, that is, when the distance H1 between the first end of the first side slot 119 and the end portion 113 increases, the radiation frequency band generated by the second radiating portion F2 shifts toward the intermediate frequency. When the length of the first side slot 119 decreases, that is, when the distance H1 between the first end of the first side slot 119 and the end portion 113 decreases, the second radiation frequency band generated by the second radiating portion F2 shifts toward the higher frequency.

Figure 8:
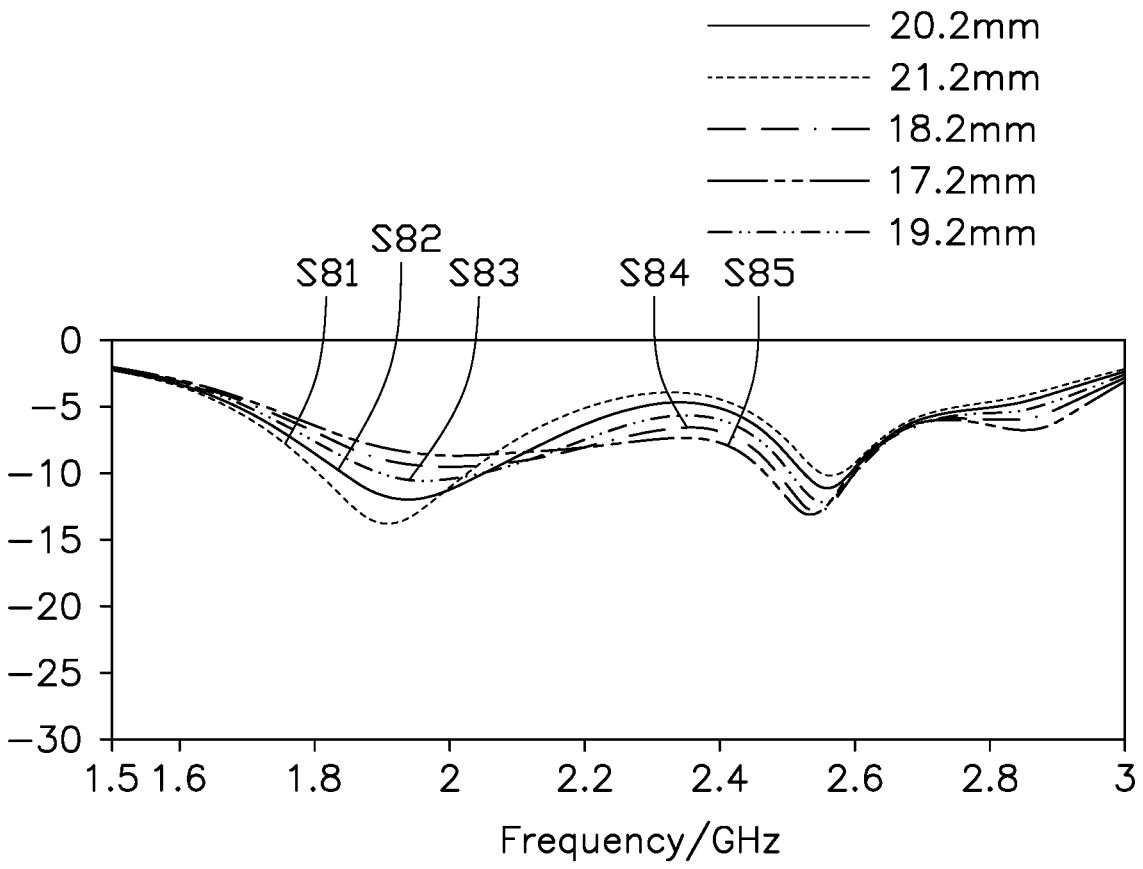
FIG. 8 shows a graph of S parameters when the length of the second side slot in the antenna structure shown in FIG. 1 is adjusted, and the antenna structure works in the LTE-A Band10 frequency band (1.71 GHz-2.17 GHz) and the LTE-A Band41 frequency band (2.49 GHz-2.69 GHz).

FIG. 8 is a graph of S parameters when the length of the second side slot 120 in the antenna structure 100 is adjusted, and the antenna structure 100 works in the LTE-A Band10 frequency band (1.71 GHz-2.17 GHz) and the LTE-A Band41 frequency band (2.49 GHz-2.69 GHz). Wherein, the curves S81, S82, S83, S84, and S85 are S11 values when the distance H2 between the first end of the second side slot 120 and the end portion 113 is 21.2 mm, 20.2 mm, 19.2 mm, 18.2 mm, and 17.2 mm, respectively, and the antenna structure 100 works in the LTE-A Band10 frequency band (1.71 GHz-2.17 GHz) and the LTE-A Band41 frequency band (2.49 GHz-2.69 GHz).

Figure 9:
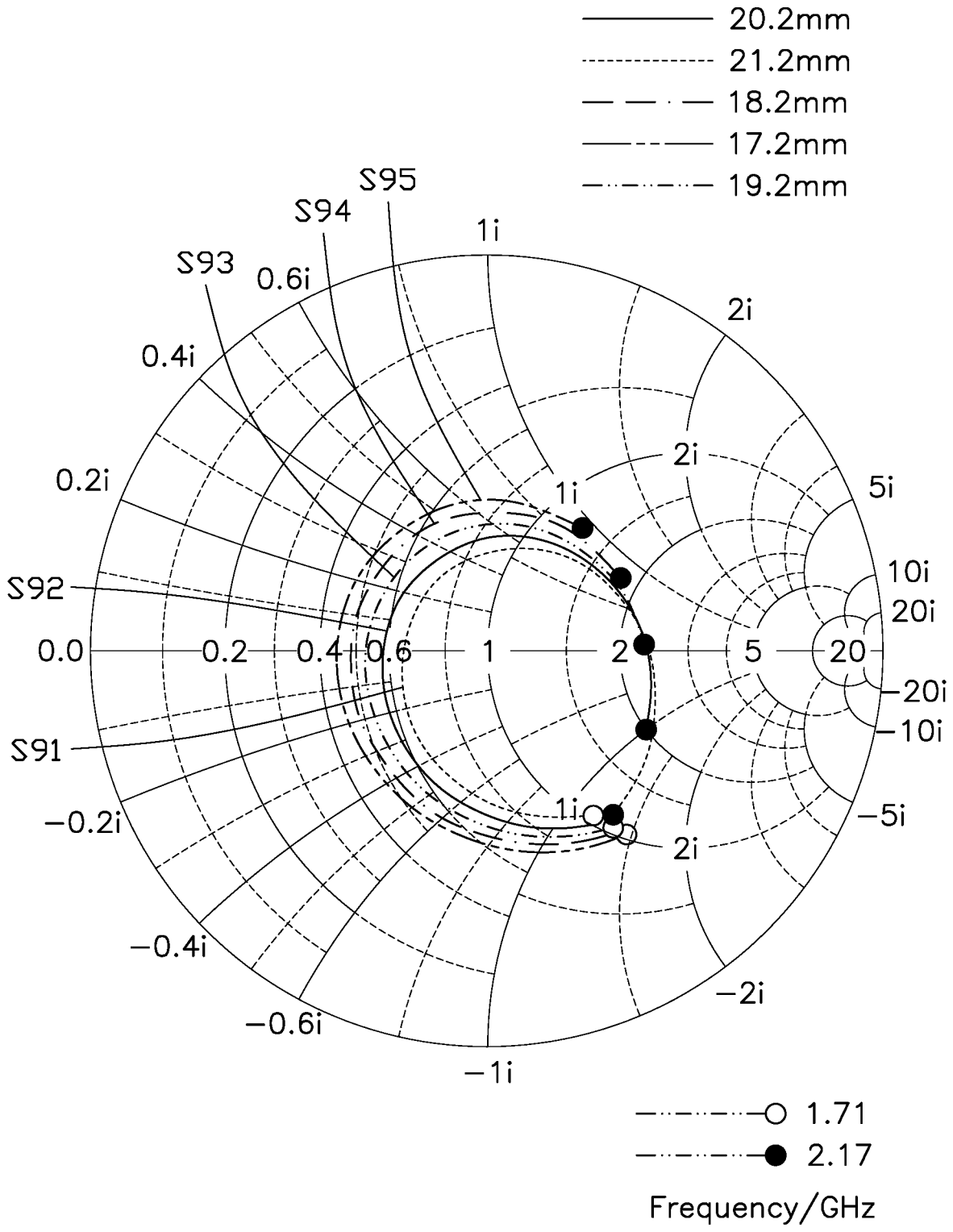
FIG. 9 is a Smith chart of the antenna structure when the length of the second side slot in the antenna structure shown in FIG. 1 is adjusted when the antenna structure operates in the LTE-A Band10 frequency band (1.71 GHz to 2.17 GHz).

FIG. 9 is a Smith chart of the antenna structure 100 operating in the LTE-A Band10 frequency band (1.71 GHz-2.17 GHz) when the length of the second side slot 120 in the antenna structure 100 is adjusted. Wherein, the curves S91, S92, S93, S94, and S95 are impedance curves when the distance H2 between the first end of the second side slot 120 and the end portion 113 is 21.2 mm, 20.2 mm, 19.2 mm, 18.2 mm, and 17.2 mm, respectively, and the antenna structure 100 works in the LTE-A Band10 frequency band (1.71 GHz-2.17 GHz).

Figure 10:
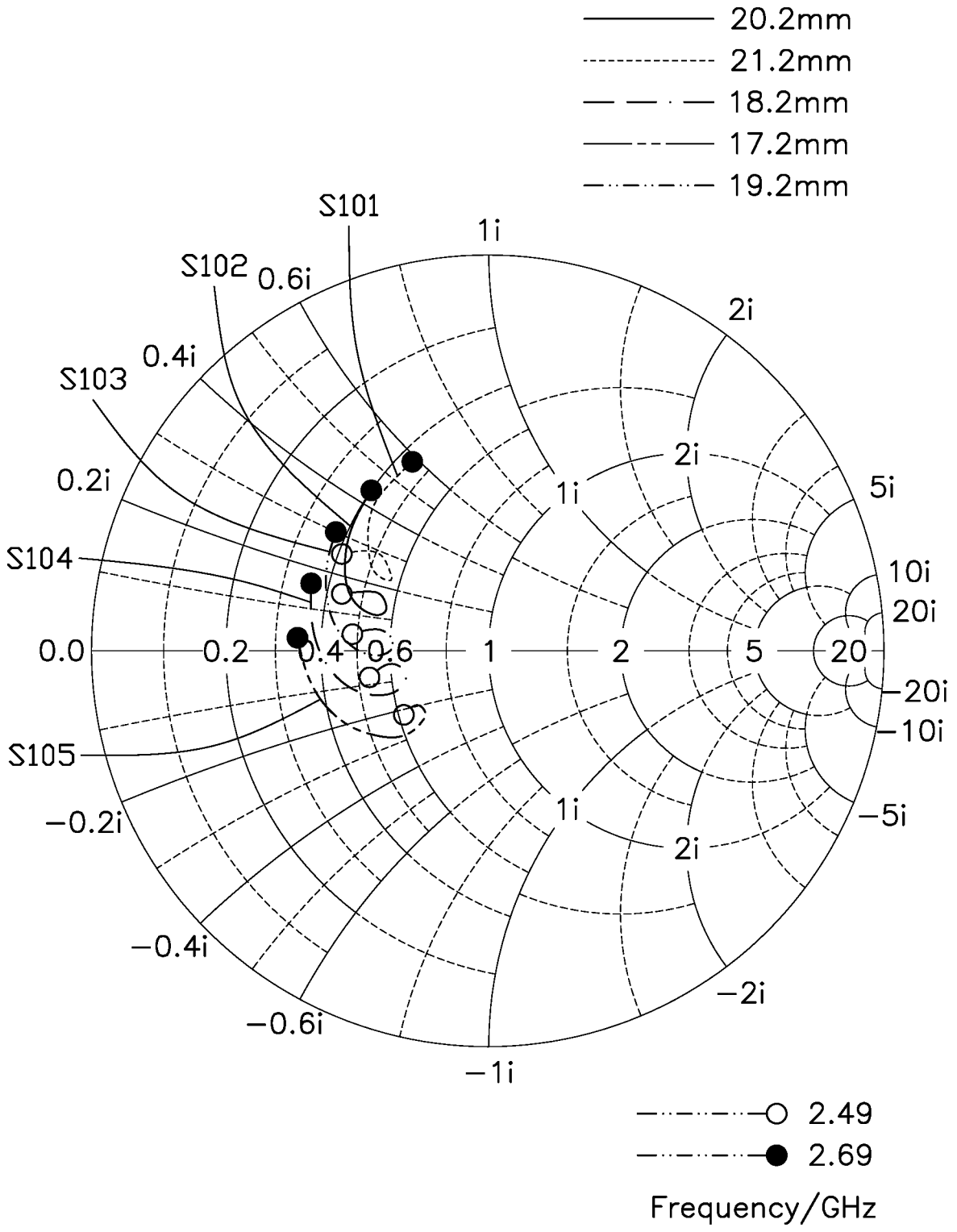
FIG. 10 is a Smith chart of the antenna structure when the length of the second side slot in the antenna structure shown in FIG. 1 is adjusted when the antenna structure operates in the LTE-A Band41 frequency band (2.49 GHz-2.69 GHz).

FIG. 10 is a Smith chart when the antenna structure 100 operates in the LTE-A Band41 frequency band (2.49 GHz-2.69 GHz) when the length of the second side slot 120 in the antenna structure 100 is adjusted. Wherein, the curves S101, S102, S103, S104, and S105 are impedance curves when the distance H2 between the first end of the second side slot 120 and the end portion 113 is 21.2 mm, 20.2 mm, 19.2 mm, 18.2 mm, and 17.2 mm, respectively, and the antenna structure 100 works in the LTE-A Band41 frequency band (2.49 GHz-2.69 GHz).

It can be seen from FIG. 8, FIG. 9, and FIG. 10 that by adjusting the length of the second side slot 120 to cause the third radiating portion F3 to work in the middle frequency band or the high frequency band, that is, 1.71 GHz-2.17 GHz or 2.49 GHz-2.69 GHz, the S11 values and the corresponding Smith chart show that the corresponding return loss and reflection coefficient are relatively low, which can meet the antenna working design requirements. Wherein, when the length of the second side slot 120 decreases, that is, when the distance H2 between the first end of the second side slot 120 and the end portion 113 decreases, the third radiation frequency band generated by the third radiating portion F3 shifts toward the high frequency.

Figure 11:
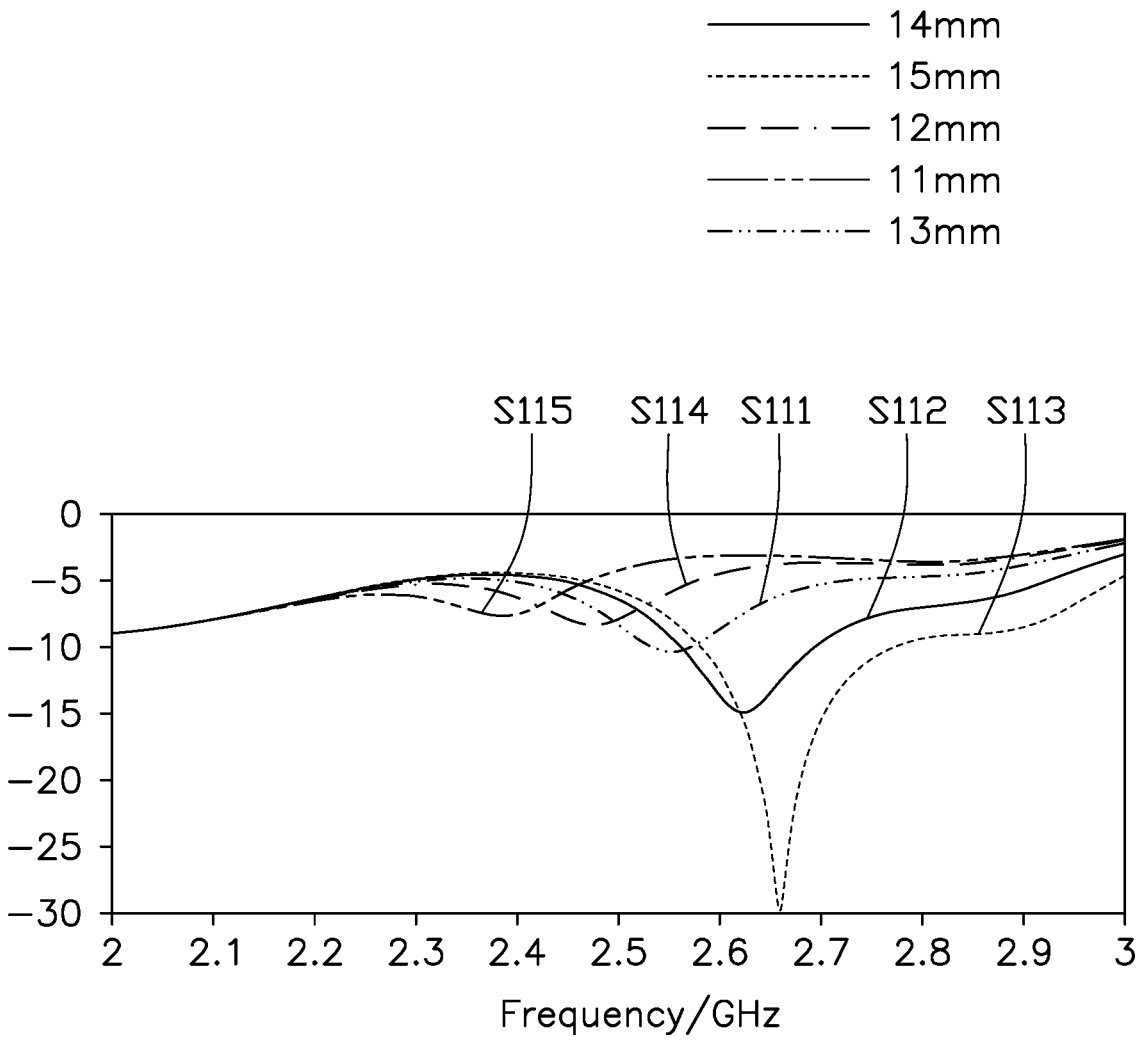
FIG. 11 is a graph of S parameters when the antenna structure works in the LTE-A high frequency mode and WIFI 2.4 mode when the distance H3 between the end of the third gap adjacent to the first gap and the end portion of the antenna structure shown in FIG. 1 is adjusted.

FIG. 11 shows a graph of S parameters when the distance H3 between the end of the third gap 121 adjacent to the first gap 117 and the end portion 113 is adjusted, and the antenna structure 100 works in the LTE-A high frequency mode and the WIFI 2.4 G mode. Wherein, the curves S111, S112, S113, S114, and S115 are S11 values when the distance H3 between the end of the third gap 121 adjacent to the first gap 117 and the end portion 113 is 13 mm, 14 mm, 15 mm, 12 mm, and 11 mm, respectively, and the antenna structure 100 works in the LTE-A Band41 frequency band (2.496 GHz-2.69 GHz), LTE-A Band38 frequency band (2.57 GHz-2.62 GHz), LTE-A Band7 frequency band (2.5 GHz-2.69 GHz), WIFI 2.4 G mode, and LTE-A Band40 frequency band (2.3 GHz-2.4 GHz).

Figure 12:
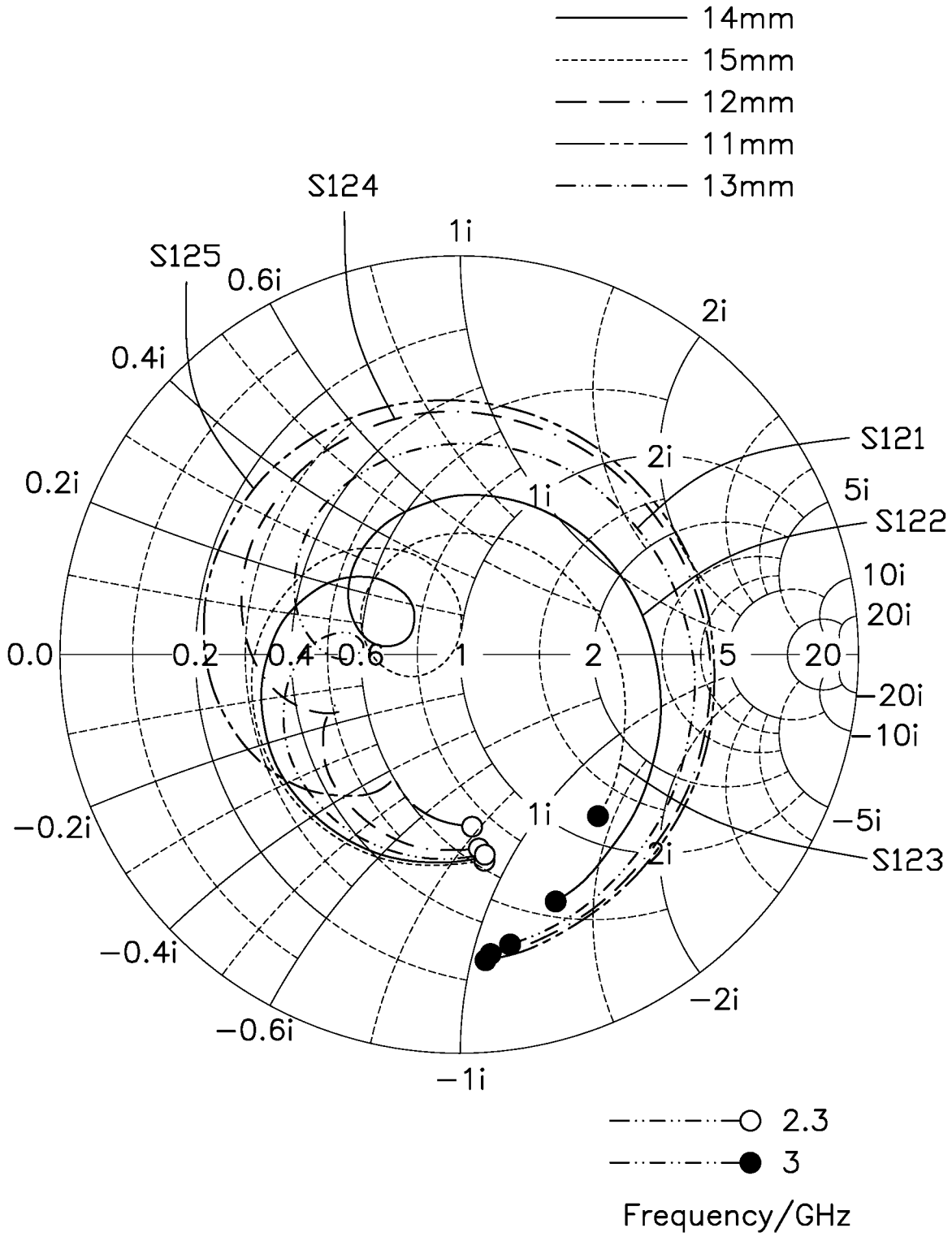
FIG. 12 is a Smith chart showing the antenna structure working in the LTE-A high frequency mode and WIFI 2.4 mode when the distance H3 between the end of the third gap adjacent to the first gap and the end portion of the antenna structure shown in FIG. 1 is adjusted.

FIG. 12 is a Smith chart when the length of the distance H3 between the end of the third gap 121 adjacent to the first gap 117 and the end portion 113 is adjusted, and the antenna structure 100 works in the LTE-A high frequency mode and WIFI 2.4 G mode, that is, the 2.3 GHz-3 GHz frequency band. Wherein, the curves S121, S122, S123, S124, and S125 are impedance curves when the distance H3 between the end of the third gap 121 adjacent to the first gap 117 and the end portion 113 is 13 mm, 14 mm, 15 mm, 12 mm, and 11 mm, respectively, and the antenna structure 100 works in the 2.3 GHz-3 GHz frequency band.

It can be seen from FIGS. 11 and 12 that by adjusting the length of the distance H3 between the end of the third gap 121 adjacent to the first gap 117 and the end portion 113 to cause the second radiating portion F2 works in LTE-A high frequency mode and WIFI 2.4 G mode, such as LTE-A Band41 frequency band (2.496 GHz-2.69 GHz), LTE-A Band38 frequency band (2.57 GHz-2.62 GHz), LTE-A Band7 frequency band (2.5 GHz-2.69 GHz), 2.4 GHz-2.5 GHz frequency band, and LTE-A Band40 frequency band (2.3 GHz-2.4 GHz), the S11 values and the corresponding Smith chart show that the corresponding return loss and reflection coefficient are low, which meet the antenna working design requirements. Wherein, when the position of the third gap 121 on the second radiating portion F2 moves in a direction away from the first radiating portion F1, the second radiation frequency band shifts toward the high frequency. When the position of the third gap 121 on the second radiating portion F2 moves toward the first radiating portion F1, the second radiation frequency band shifts to the low frequency.

Figure 13:
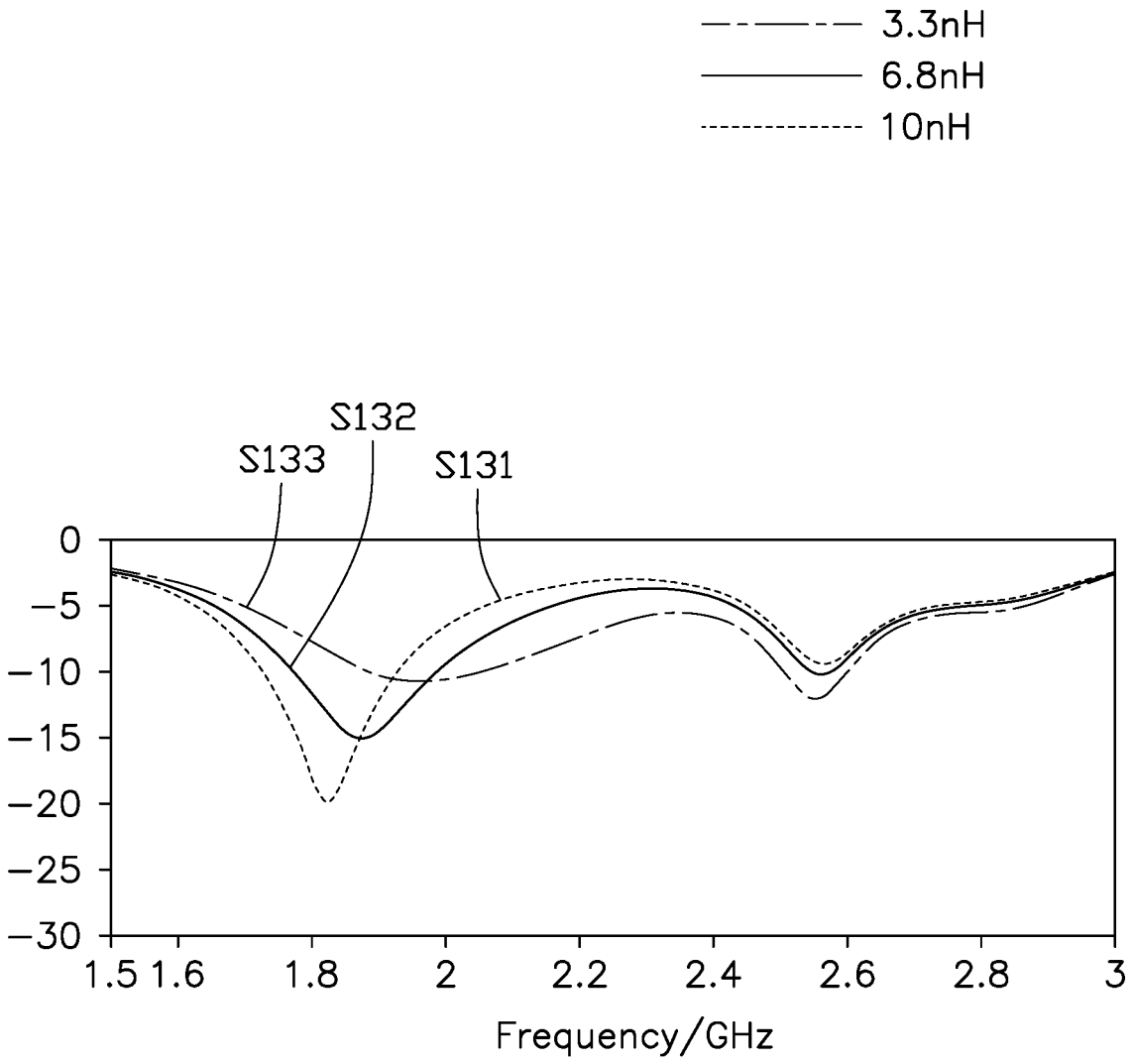
FIG. 13 is a graph of S parameters when the antenna structure works in the LTE-A intermediate frequency mode when the matching circuit shown in FIG. 4 is switched to a different inductance.

FIG. 13 is a graph of S parameters when the antenna structure 100 works in the LTE-A intermediate frequency mode when the matching circuit 131 shown in FIG. 4 is switched to a different inductance. Wherein, the curves S131, S132, and S133 are S11 values when the inductance values of the matching circuit 131 are 10 nH, 6.8 nH, and 3.3 nH, respectively, and the antenna structure 100 works in the LTE-A Band3 frequency band (1.71 GHz-1.88 GHz), LTE-A Band2 frequency band (1.85 GHz-1.99 GHz), and LTE-A Band1 frequency band (1.92 GHz-2.17 GHz).

Figure 14:
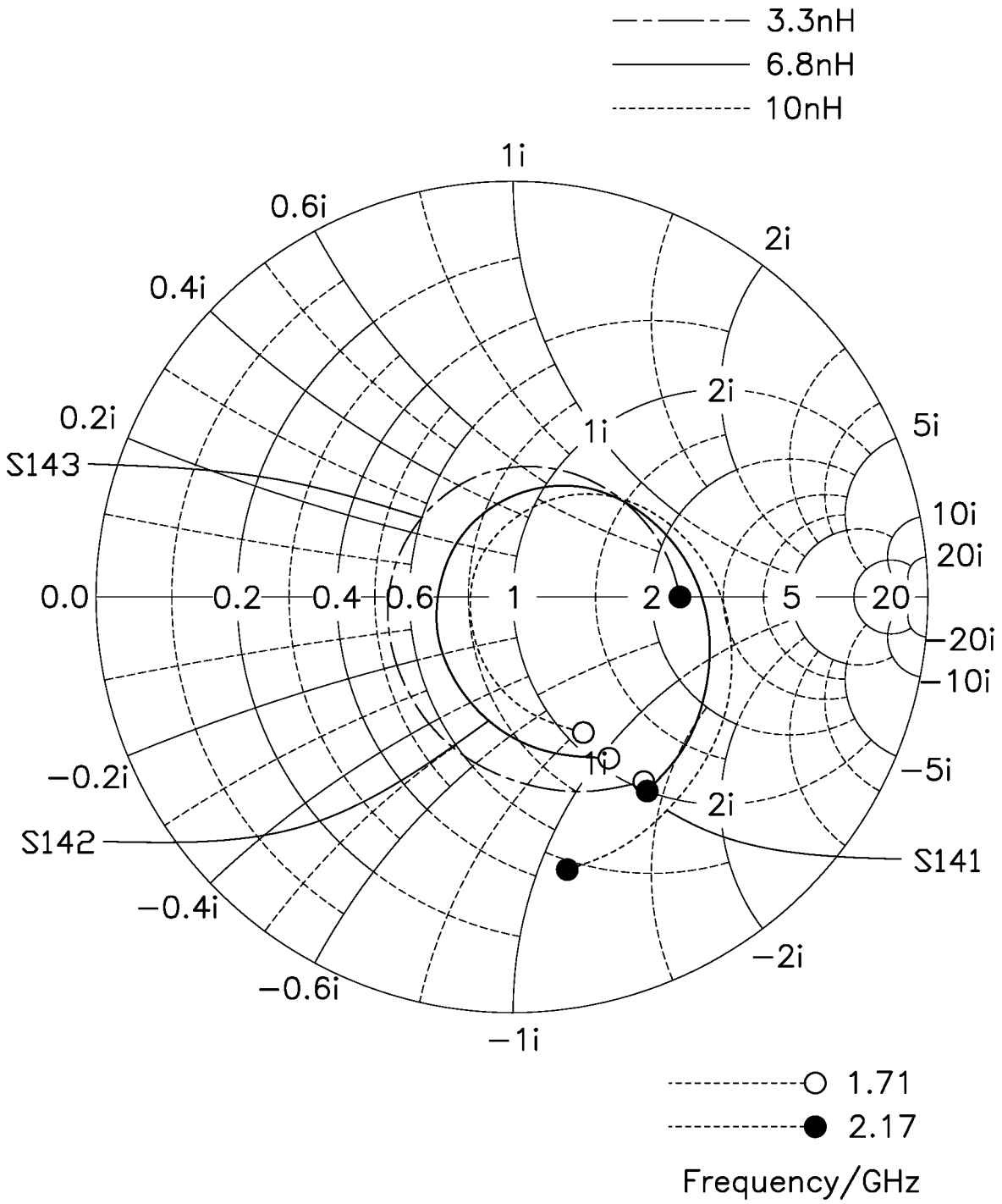
FIG. 14 is a Smith chart of the antenna structure operating in the LTE-A intermediate frequency mode when the matching circuit shown in FIG. 4 is switched to a different inductance.

FIG. 14 is a Smith chart of the antenna structure 100 when the matching circuit 131 shown in FIG. 4 is switched to a different inductance when the antenna structure 100 works in the LTE-A intermediate frequency mode, that is, the 1.71 GHz-2.17 GHz band. Wherein, the curves S141, S142, and S143 are impedance curves when the inductance values of the matching circuit 131 are 10 nH, 6.8 nH, and 3.3 nH, respectively, and the antenna structure 100 operates in the frequency band 1.71 GHz-2.17 GHz.

It can be seen from FIG. 13 and FIG. 14 that by adjusting the inductance value of the matching circuit 131 of the ground portion 13 to cause the third radiating portion F3 works in the third radiation frequency band, that is, the LTE-A intermediate frequency band or the UMTS frequency band, that is, 1.71 GHz-2.17 GHz, the return loss and reflection coefficient are low, which can meet the antenna working design requirements. Wherein, when the inductance value of the third inductor L3 decreases, the third radiation frequency band shifts from the intermediate frequency toward the high frequency.

Figure 15:
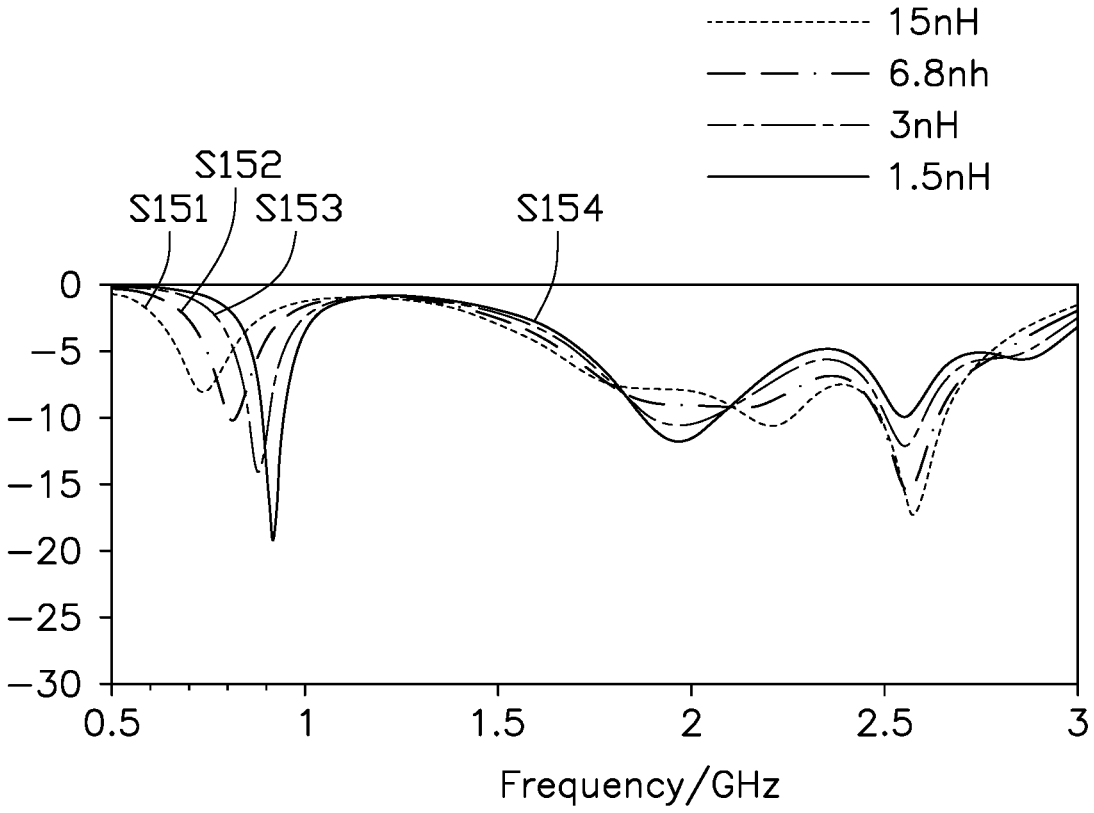
FIG. 15 is a graph of S parameters when the antenna structure works in the LTE-A low frequency mode when the switching circuit shown in FIG. 5 is switched to different inductances.

FIG. 15 is a graph of S parameters when the antenna structure 100 works in the LTE-A low frequency mode when the switching circuit 14 shown in FIG. 5 is switched to different inductances. Wherein, the curves S151, S152, S153, and S154 are S11 values when the fourth inductor L4 of the switching circuit 14 is switched to inductance values of 15 nH, 6.8 nH, 3 nH, and 1.5 nH, and the antenna structure 100 works in the LTE-A Band17 frequency band (704-746 MHz), LTE-A Band13 frequency band (746 MHz-787 MHz), LTE-A Band20 frequency band (791 MHz-862 MHz), and LTE-A Band8 frequency band (880 MHz-960 MHz).

Figure 16:
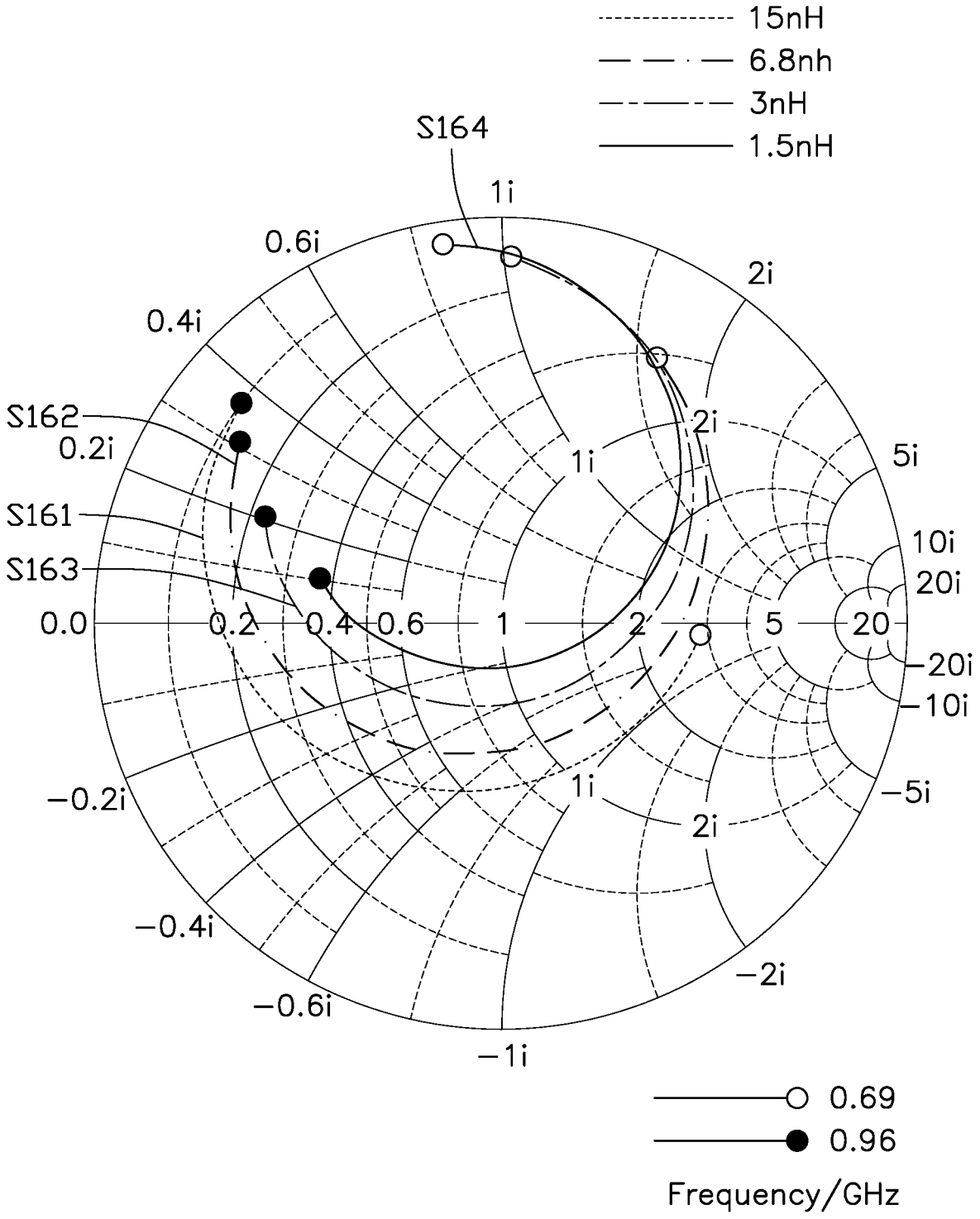
FIG. 16 is a Smith chart of the antenna structure operating in the LTE-A low frequency mode when the switching circuit shown in FIG. 5 is switched to different inductances.

FIG. 16 is a Smith chart of the antenna structure 100 when the switching circuit shown in FIG. 5 is switched to a different inductance when the antenna structure 100 operates in the frequency band between 0.69 GHz and 0.96 GHz. Wherein, the curves S71, S72, S73, and S74 are impedance curves when the fourth inductor L4 of the switching circuit 14 is switched to 15 nH, 6.8 nH, 3 nH, and 1.5 nH, respectively, and the antenna structure 100 operates in the 0.69 GHz-0.96 GHz frequency band.

It can be seen from FIG. 15 and FIG. 16 that by adjusting the inductance value of the fourth inductor L4 of the switching circuit 14 to cause the first radiating portion F1 to work in the LTE-A low frequency band, that is, 0.69 GHz-0.96 GHz, the return loss and reflection coefficient are low, which can meet the requirements of antenna working design. Wherein, when the inductance value of the fourth inductor L4 decreases, the first radiation frequency band shifts from a low frequency to an intermediate frequency.

It can be understood that the antenna structure 100 defines a first radiating portion F1, a second radiating portion F2, and a third radiating portion F3 from the frame portion 110 by setting a first gap 117 and a second gap 118. The antenna structure 100 is further provided with a feeding portion 12, and when the feeding portion 12 feeds current, the current flows through the first radiating portion F1, flows to the first gap 117, and passes through the switching circuit 14, and then is grounded to excite the GSM mode and the LTE-A low frequency mode to generate the low frequency radiation signal of the first radiation frequency band. The current flowing to the first gap 117 is also coupled to the second radiating portion F2 through the first gap 117, and is grounded through the second radiating portion F2, so as to excite the LTE-A high frequency mode, the Bluetooth mode, and WIFI 2.4 G mode to generate high frequency radiation signals in the second radiation frequency band. The current also flows to the second gap 118, and the current flowing to the second gap 118 is also coupled to the third radiating portion F3 through the second gap 118, and is grounded through the ground portion 13 to excite the LTE-A intermediate frequency mode and the UMTS mode to generate the radiation signals in the third radiation frequency band. That is, the antenna structure 100 can cover the receiving and transmitting functions of GSM, UMTS, and LTE-A low frequency, intermediate frequency, and high frequency bands.

Furthermore, the first side slot 119 is formed on the inner side of the second radiating portion F2, and the second side slot 120 is formed on the inner side of the third radiating portion F3. By adjusting the length of the first side slot 119 and/or the second side slot 120, the radiation frequency band of the second radiating portion F2 and/or the third radiating portion F3 can be effectively adjusted, thereby flexibly adjusting the frequency of the intermediate frequency band and high frequency band of the antenna structure 100. The second radiating portion F2 is further provided with the third gap 121, and the frequency of the second radiation frequency band can be adjusted by adjusting the position of the third gap 121 on the second radiating portion F2.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

What is claimed is:

1. An antenna structure comprising:

a frame portion comprising a first gap and a second gap, the first gap and the second gap penetrating and dividing the frame portion into a first radiating portion, a second radiating portion, and a third radiating portion;

a middle frame portion, the frame portion being on a periphery of the middle frame portion;

a ground portion;

a feeding portion on the first radiating portion adjacent to the second gap, one end of the feeding portion electrically coupled to the first radiating portion, and another end of the feeding portion electrically coupled to a feeding point to feed current to the first radiating portion; wherein:

the second radiating portion and/or the third radiating portion comprises a side slot;

a side of the middle frame portion adjacent to the second radiating portion is hollowed out to form the first side slot, and the first side slot extends from the second radiating portion to the first radiating portion;

a side of the middle frame portion adjacent to the third radiating portion is hollowed out to form the second side slot, and the second side slot extends from the third radiating portion to the first radiation portion;

a radiation frequency band of the second radiating portion and/or the third radiating portion where the side slot is located is adjustable by designing a length of the side slot during manufacturing;

the feeding portion is on the first radiating portion;

an electric current path is defined from the feeding portion feeds to the first radiating portion, when the first radiation portion is excited by an electric current, the antenna structure is in a first mode wherein a radiation signal is generated in a first radiation frequency band, the first mode comprises the Global System for Mobile Communications (GSM) mode and the Long Term Evolution Advanced (LTE-A) low frequency mode;

an electric current is defined from the feeding portion to the first gap and the second gap, respectively, and the first gap is electrically coupled to the second radiating portion and the second radiating portion is grounded, when the second radiating portion is excited by an electric current, the antenna structure is in a second mode wherein a radiation signal is generated in a second radiation frequency band, the second mode comprises a long-term evolution technology upgraded high frequency mode, a Bluetooth mode, and a WIFI 2.4G mode;

the second gap is electrically coupled to the third radiating portion, and the third radiating portion is grounded, when the third radiating portion is excited by an electric current, the antenna structure is in a third mode wherein a radiation signal is generated in a third radiation frequency band, the third mode comprises a long-term evolution technology upgraded intermediate frequency mode and a Universal Mobile Telecommunications System (UMTS) mode;

the ground portion is on the third radiating portion;

one end of the ground portion is electrically coupled to the third radiating portion, and another of the ground portion is electrically coupled to a ground point through a third inductor; and when an inductance value of the third inductor decreases, the third radiating frequency band shifts from the intermediate frequency to a high frequency.

2. The antenna structure of claim 1, wherein:

when a length of the first side slot increases, the second radiation frequency band shifts toward an intermediate frequency;

when the length of the first side slot decreases, the second radiation frequency band shifts toward a high frequency; and when a length of the second side slot decreases, the third radiation frequency band shifts toward a high frequency.

3. The antenna structure of claim 1, wherein:

the second radiating portion further comprises a third gap;

the third gap is spaced from the first gap, the third gap divides the second radiating section into a first radiating section and a second radiating section;

an electric current path is defined from the feeding portion, to the first gap, and to the first radiating section; and an electric current path is defined from the first radiating section, to the third gap, and to the second radiating section.

4. The antenna structure of claim 3, wherein:

when a position of the third gap on the second radiating portion is designed away from the first radiating portion during manufacturing, the second radiation frequency band shifts to a high frequency; and when the position of the third gap on the second radiating portion is designed toward the first radiating portion during manufacturing, the second radiation frequency band shifts to a low frequency.

5. The antenna structure of claim 1, wherein:

the feeding portion is electrically coupled to the feeding point through a matching circuit;

the matching circuit comprises a first inductor, a second inductor, and a capacitor;

one end of the first inductor is grounded, and another end of the first inductor is electrically coupled to the feeding portion;

one end of the second inductor is electrically coupled to the feeding point, and another end of the second inductor is electrically coupled to the feeding portion;

one end of the capacitor is grounded, and another end of the capacitor is electrically coupled to the feeding portion.

6. The antenna structure of claim 1, further comprising a switching circuit, wherein: the switching circuit comprises a fourth inductor, one end of the fourth inductor is electrically coupled to the first radiating portion, and another end of the fourth inductor is electrically coupled to the ground point; and when an inductance value of the fourth inductor decreases, the first radiation frequency band shifts from a low frequency to an intermediate frequency.

7. A wireless communication device comprising an antenna structure, the antenna structure comprising:

a frame portion provided with a first gap and a second gap, the first gap and the second gap penetrating and dividing the frame portion into a first radiating portion, a second radiating portion, and a third radiating portion;

a middle frame portion, the frame portion being on a periphery of the middle frame portion;

a ground portion;

a feeding portion arranged on the first radiating portion adjacent to the second gap, one end of the feeding portion electrically coupled to the first radiating portion, and the other end of the feeding portion electrically coupled to a feeding point to feed current to the first radiating portion; wherein:

the second radiating portion and/or the third radiating portion is provided with a side slot;

a side of the middle frame portion adjacent to the second radiating portion is hollowed out to form the first side slot, and the first side slot extends from the second radiating portion to the first radiating portion;

a side of the middle frame portion adjacent to the third radiating portion is hollowed out to form the second side slot, and the second side slot extends from the third radiating portion to the first radiation portion; and a radiation frequency band of the second radiating portion and/or the third radiating portion where the side slot is located is adjusted by designing the length of the side slot during manufacturing;

the feeding portion is arranged on the first radiating portion;

after the feeding portion feeds current, the current flows through the first radiating portion to excite a first mode to generate a radiation signal in a first radiation frequency band, the first mode comprising the Global System for Mobile Communications (GSM) mode and the Long Term Evolution Advanced (LTE-A) low frequency mode;

the current also flows to the first gap and the second gap, and the current flowing to the first gap is coupled to the second radiating portion and is grounded through the second radiating portion to excite a second mode to generate a radiation signal in a second radiation frequency band, the second mode comprising a long-term evolution technology upgraded high frequency mode, a Bluetooth mode, and a WIFI 2.4G mode;

the current flowing to the second gap is coupled to the third radiating portion through the second gap, and is grounded through the third radiating portion to excite a third mode to generate a radiation signal in a third radiation frequency band, the third mode comprising a long-term evolution technology upgraded intermediate frequency mode and a Universal Mobile Telecommunications System (UMTS) mode;

the ground portion is provided on the third radiating portion;

one end of the ground portion is electrically coupled to the third radiating portion, and the other end of the ground portion is electrically coupled to a ground point through a third inductor; and when an inductance value of the third inductor decreases, the third radiating frequency band shifts from the intermediate frequency to a high frequency.

8. The wireless communication device of claim 7, wherein:

when the length of the first side slot increases, the second radiation frequency band shifts toward an intermediate frequency;

when the length of the first side slot decreases, the second radiation frequency band shifts toward a high frequency; and when the length of the second side slot decreases, the third radiation frequency band shifts toward a high frequency.

9. The wireless communication device of claim 8, wherein:

the second radiating portion is further provided with a third gap;

the third gap is spaced from the first gap, the third gap divides the second radiating section into a first radiating section and a second radiating section;

after the feeding portion feeds current, the current flowing to the first gap is coupled to the first radiating section through the first gap; and the current flowing through the first radiating section is coupled to the second radiating section through the third gap.

10. The wireless communication device of claim 9, wherein:

when the position of the third gap on the second radiating portion is designed away from the first radiating portion during manufacturing, the second radiation frequency band shifts to a high frequency; and when the position of the third gap on the second radiating portion is designed toward the first radiating portion during manufacturing, the second radiation frequency band shifts to a low frequency.

11. The wireless communication device of claim 10, wherein:

the feeding portion is electrically coupled to the feeding point through a matching circuit;

the matching circuit comprises a first inductor, a second inductor, and a capacitor;

one end of the first inductor is grounded, and the other end of the first inductor is electrically coupled to the feeding portion;

one end of the second inductor is electrically coupled to the feeding point, and the other end of the second inductor is electrically coupled to the feeding portion;

one end of the capacitor is grounded, and the other end of the capacitor is electrically coupled to the feeding portion.

12. The wireless communication device of claim 11, wherein:

the antenna structure further comprises a switching circuit; the switching circuit comprises a fourth inductor, one end of the fourth inductor is electrically coupled to the first radiating portion, and the other end of the fourth inductor is electrically coupled to the ground point; and when an inductance value of the fourth inductor decreases, the first radiation frequency band shifts from a low frequency to an intermediate frequency.

* * * * *